US007251971B2

(12) United States Patent
Reinschke et al.

(10) Patent No.: US 7,251,971 B2
(45) Date of Patent: Aug. 7, 2007

(54) METHOD FOR REGULATING THE TEMPERATURE OF STRIP METAL

(75) Inventors: Johannes Reinschke, Nürnberg (DE); Klaus Weinzierl, Nürnberg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/545,701

(22) PCT Filed: Feb. 13, 2004

(86) PCT No.: PCT/EP2004/001365

§ 371 (c)(1),
(2), (4) Date: Aug. 16, 2005

(87) PCT Pub. No.: WO2004/076085

PCT Pub. Date: Sep. 10, 2004

(65) Prior Publication Data

US 2006/0225474 A1 Oct. 12, 2006

(30) Foreign Application Priority Data

Feb. 25, 2003 (DE) ..... 103 08 222
May 14, 2003 (DE) ..... 103 21 792

(51) Int. Cl.
*B21B 37/74* (2006.01)

(52) U.S. Cl. ..... 72/8.5; 72/12.2; 72/16.5; 72/18.3; 72/19.1; 72/200; 72/201; 72/342.2; 700/30; 700/33; 700/153

(58) Field of Classification Search ..... 700/108, 700/28–33, 148, 150, 153; 72/200, 201, 72/342.2, 342.6, 8.5, 12.2, 16.5, 18.3, 19.1; 148/511; 266/87
See application file for complete search history.

(56) References Cited

U.S. PATENT DOCUMENTS

| | | | | |
|---|---|---|---|---|
| 5,126,947 | A | 6/1992 | Koyama | |
| 5,691,921 | A * | 11/1997 | Berlin | 702/99 |
| 6,185,970 | B1 | 2/2001 | Latzel | |
| 6,225,609 | B1 * | 5/2001 | Imanari et al. | 219/494 |
| 6,430,461 | B1 * | 8/2002 | Andorfer et al. | 700/148 |
| 6,866,729 | B2 * | 3/2005 | Gramckow et al. | 148/511 |
| 7,085,619 | B2 * | 8/2006 | Broese et al. | 700/164 |

FOREIGN PATENT DOCUMENTS

| | | | |
|---|---|---|---|
| DE | 197 17 615 | A1 | 10/1998 |
| DE | 199 63 186 | A1 | 7/2001 |
| EP | 1 014 239 | A1 | 6/2000 |
| JP | 58221606 | A * | 12/1983 |
| JP | 09 285810 | A | 11/1997 |

* cited by examiner

*Primary Examiner*—Dmitry Suhol

(57) ABSTRACT

The invention relates to a method for controlling or regulating the temperature of a metal strip in a cooling path of a hot rolling system. A desired temperature gradient is compared to an actual temperature gradient in order to determine adjusting signals for the cooling path. At least one target function is formed for actuators of the cooling strip, taking into account auxiliary conditions, and said target function is solved as a quadratic optimization problem for the purpose of model predictive regulation. The invention also relates to an overlapping regulation for the finishing train and the cooling path of the hot rolling system.

14 Claims, 6 Drawing Sheets

METHOD FOR REGULATING THE TEMPERATURE OF STRIP METAL

CROSS REFERENCE TO RELATED APPLICATIONS

This application claims priority to the German applications No. 10308222.0, filed Feb. 25, 2003 and No. 10321792.4, filed May 14, 2003, and to the International Application No. PCT/EP2004/001365, filed Feb. 13, 2004 which are incorporated by reference herein in their entirety.

FIELD OF INVENTION

The invention relates to a method for controlling or, as the case may be, regulating the temperature of strip metal in a system employed in the steel industry, especially in a cooling path located downstream of a rolling train for rolling hot strip metal.

BACKGROUND OF INVENTION

A controlling method for a cooling path upstream whereof is located a finishing train for rolling hot strip metal is known from DE 199 63 186 A1. With that controlling method, points on the strip and their initial temperatures are registered when the hot strip runs into the cooling path and the registered points on the strip are individually assigned desired temperature gradients. The points on the strip, their initial temperatures, and their desired temperature gradients are routed to a model for the cooling path. The points on the strip are route-tracked during their passage through the cooling path. The hot strip is subjected in the cooling path to temperature influences by means of temperature-influencing devices. The route-tracking data and the temperature influences are likewise routed to the model. The model determines expected actual temperatures of the registered points on the strip in realtime and assigns these to the points on the strip. The temperature is thereby available for each point on the strip at any time as a function over the strip thickness. On the basis of the desired temperature gradients assigned to the registered points on the strip and of the expected actual temperatures, the model furthermore determines drive values for the temperature-influencing devices and routes said drive values thereto. Temperature controlling serves especially to selectively establish material and structural properties of the hot strip metal, with said temperature controlling being as a rule embodied in such a way that a pre-determined reel temperature gradient is achieved as well as possible from the output of the cooling path.

SUMMARY OF INVENTION

Alongside chemical composition and reshaping-process parameters, factors such as, for instance, pick-up distribution across the stands of the finishing groups and the temporal temperature gradient of the strip material during its passage through the system are crucial in determining certain material and structural properties of the hot strip metal.

The final actuators for the temperature gradient of the strip metal within the system are as a rule located within the cooling path. The material's phase transformation frequently also takes place in the cooling path. The valves of the cooling path as a rule serve as actuators. In the case of certain cooling paths such as, for instance, plate-rolling trains the mass rate of flow, which is to say in particular the strip speed, can be set in addition.

An object of the present invention is to improve controlling or, as the case may be, regulating of the temperature of strip metal, especially in a cooling path, in a system employed in the steel industry in such a way that the disadvantages of known controlling or, as the case may be, regulating will for the most part be avoided and the efficiency of controlling or, as the case may be, regulating will be increased.

Said object is achieved by means of a method for controlling and/or regulating the temperature of strip metal in a system employed in the steel industry, especially in a cooling path located downstream of a rolling train for rolling hot strip metal, with a desired temperature gradient being compared for the purpose of determining adjusting signals with an actual temperature gradient, and with points on the strip being route-tracked with a temperature gradient being determined for individual points on the strip, and with at least one target function being formed for a plurality of actuators in a regulating section of the system, especially in the cooling path, taking secondary conditions into account.

Taking account of secondary conditions corresponding preferably to system limits or, as the case may be, adjustment limitations makes it possible to determine (adjustment) specifications that take practical account of adjustment limitations especially for different cooling-path layouts and, above all, for the eventuality of a predefined temperature gradient or, as the case may be, cooling gradient. In the case of, for example, a cooling path divided in two, the consequence that the reel temperature will no longer be attainable with the amount of coolant available in the second partial cooling path when an excessively high temperature has been specified between the two partial cooling paths will be obviated. Controlling or, as the case may be, regulating accuracy will be significantly improved in such a way and especially also through route-tracking of the points on the strip.

The target function will advantageously be minimized or, as the case may be, maximized through solving an optimization problem. Controlling or, as the case may be, regulating will also be possible in such a way when a temperature gradient or, as the case may be, cooling gradient is specified that cannot be exactly implemented. The method will then determine the best possible approximation.

A quadratic optimization problem is advantageously solved. The time taken to solve the optimization problem will as a rule be significantly reduced in such a way.

The strip metal's actual temperature gradient and/or desired temperature gradient is advantageously determined with the aid of at least one model. Improved controlling or, as the case may be, regulating of the strip metal's temperature will also be enabled in such a way when said strip's actual temperature cannot be measured at locations relevant to controlling or, as the case may be, regulating, especially along the cooling path.

The actual enthalpy gradient and/or desired enthalpy gradient is determined alternatively or in addition.

The target function will advantageously be minimized or, as the case may be, maximized through solving an optimization problem using predictive calculating. The time needed for pre-adjusting the actuators will in particular be significantly reduced in this way. Said actuators will, moreover, preferably be optimally pre-adjusted in such a way in terms of a succeeding online regulating operation.

The target function will advantageously be minimized or, as the case may be, maximized preferably online through solving an optimization problem iteratively.

Advantageous developments of the method are indicated in the dependent claims.

Further ways of achieving the object according to the invention are indicated in further independent and corresponding dependent claims.

BRIEF DESCRIPTION OF THE DRAWINGS

Further advantages and specifics will emerge from the description that follows of several exemplary embodiments of the invention in conjunction with the drawings. By way of example

DETAILED DESCRIPTION OF INVENTION

Figure 1:
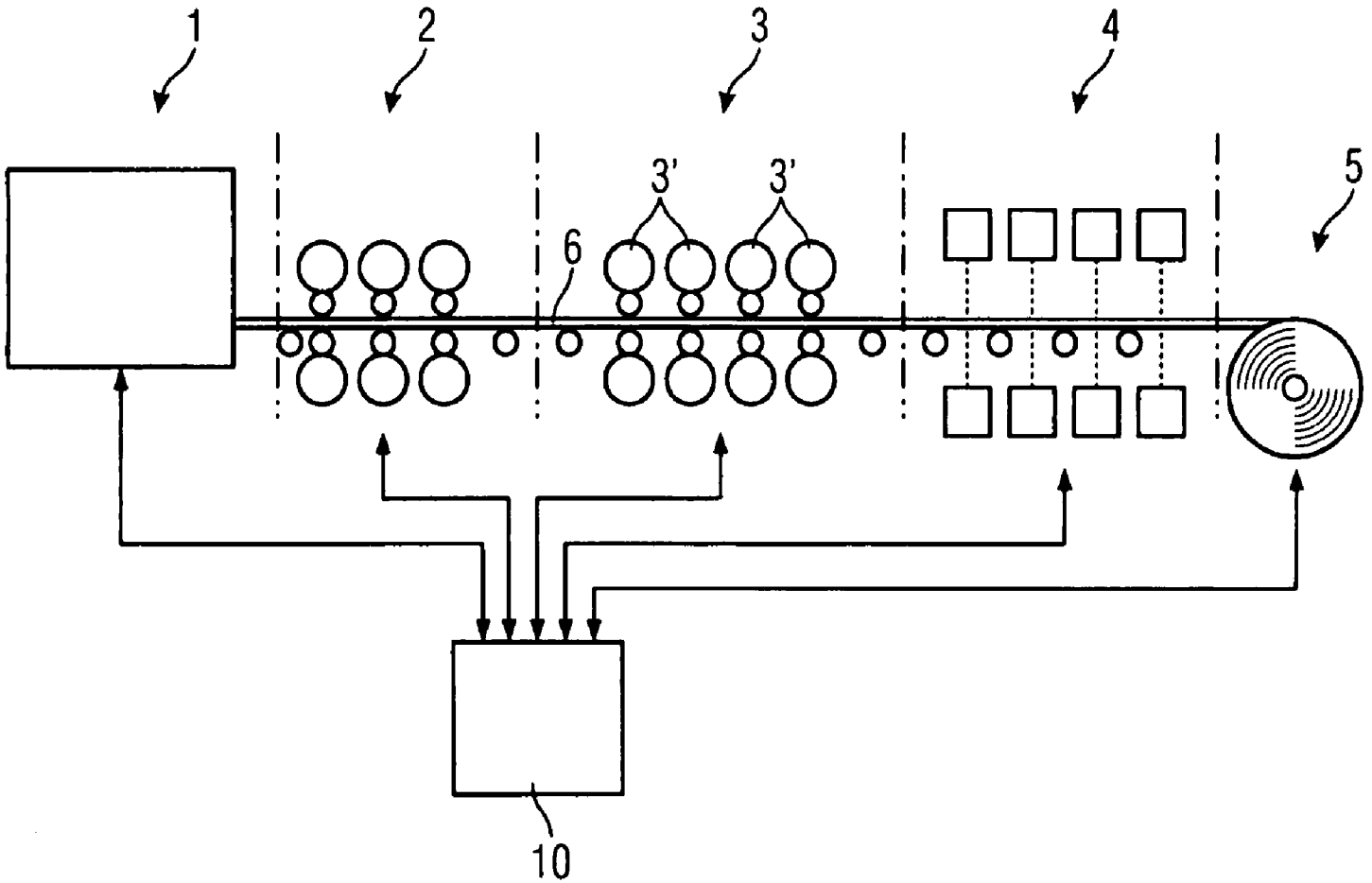
FIG. 1 shows the basic structure of a rolling mill.

FIG. 1 shows a system designed for producing strip metal 6 and including a preliminary train 2, a finishing train 3, and a cooling path 4, with said strip metal 6 being rolled preferably while hot. A reeling device 5 is preferably located behind the cooling path 4. The strip metal 6 rolled in the trains 2 and 3 and cooled in the cooling path 4 is reeled up by said device. A strip source 1 is located upstream of the train 2 or, as the case may be, 3. The strip source 1 is embodied as, for example, a furnace in which plate-metal slabs are heated. The strip source 1 can also be embodied as, for example, a continuous-casting system in which strip metal 6 is produced which is then routed to the preliminary train 2.

The system for producing steel, and especially the trains 2, 3 and the cooling path 4, and the at least one reeling device 5 are controlled by means of a controlling method implemented using a calculating device 10. The calculating device 10 is for this purpose coupled in controlling terms to one or more of the components 1 to 5 of the system for producing steel. The calculating device 10 is programmed by means of a control program which is embodied as a computer program and on the basis of which it implements the method according to the invention for controlling or, as the case may be, regulating the temperature of the strip metal 6.

According to FIG. 1 the strip metal or, as the case may be, slab 6 exits the strip source 1 and is initially rolled in the preliminary train 2 to an input thickness for the finishing path 3. The strip 6 is then rolled within the finishing train to its final thickness by means of the rolling stands 3'. The cooling path 4 which follows cools the strip to the specified reel temperature.

A suitable temperature gradient for the finishing train 3 and the cooling path 4 must be maintained in order to ensure required mechanical properties of the strip 6. A desired temperature gradient that is dependent on, for example, the system type, the operating mode, the relevant job order, and required properties of the strip metal 6 is preferably specified for this purpose.

Figure 5:
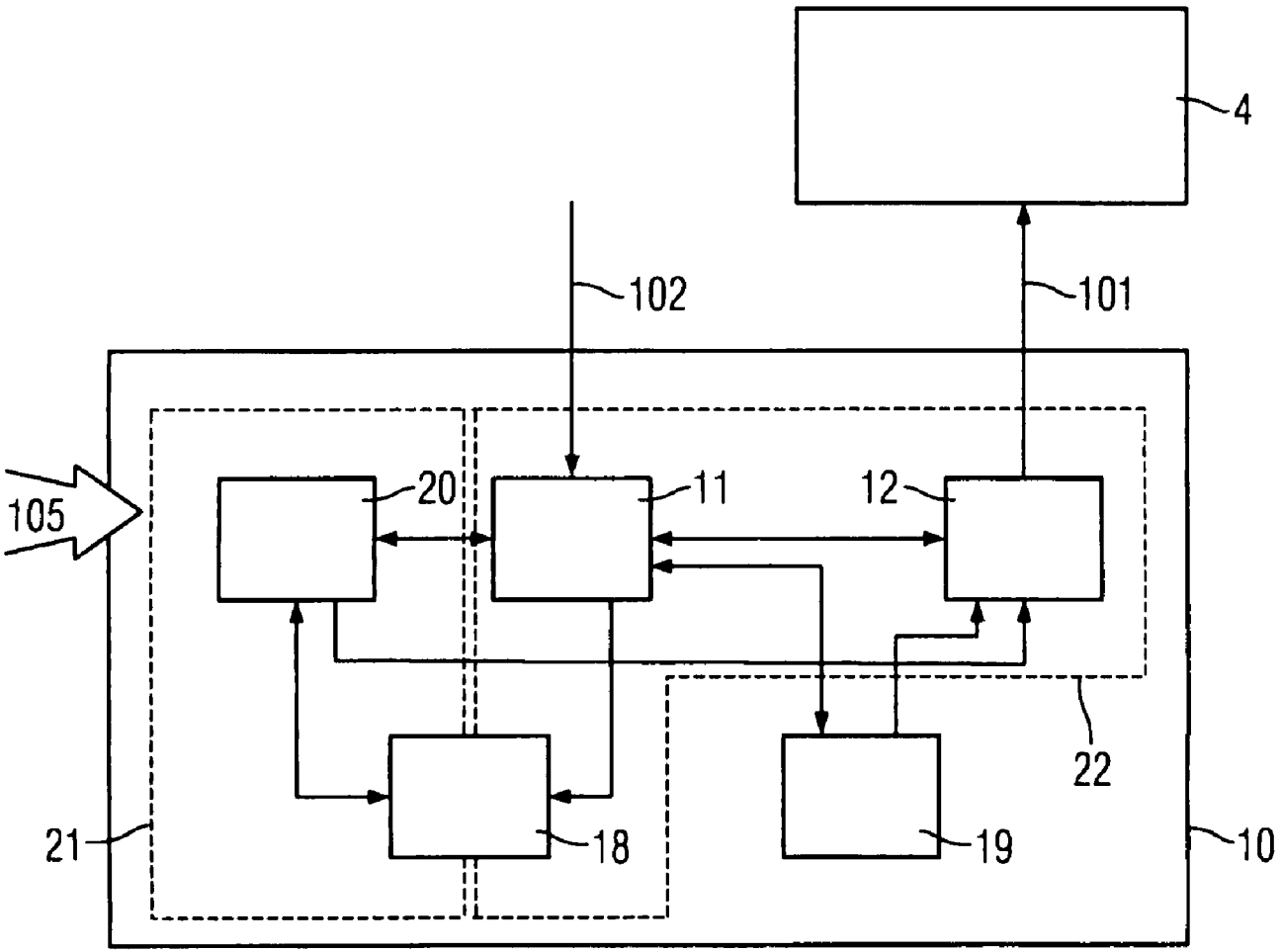
FIG. 5 shows predictive calculating and an instance of realtime regulating of a cooling path.

FIG. 5 shows a calculating device 10 for controlling a cooling path 4, with said device 10 having a predictive-calculation module 21 and a module 22 for preferably online calculations especially during the cooling process.

The actuators of the finishing train 4 can be initialized with the aid of the predictive-calculation module 21. Estimates for missing measurands, for instance the strip metal's input speed, its temperature at the end of the finishing train 3, and the strip thickness are employed, for instance, for this purpose. Required material values 105, for example, serve as input values on the operator side for the predictive-calculation module 21.

Predictive calculating 20 within the predictive-calculation module 21 takes place iteratively. This means that calculations are repeated applying different amounts of coolant until specified errors have been minimized. Predictive calculating 20 is therefore coupled to an online-enabled cooling-path monitor 11 and to an adaptation means 18.

The calculation module 22 has a cooling-path monitor 11 and a cooling-path regulating means 12 that are coupled to each other. The cooling-path monitor 11 and the cooling-path regulating means 12 control the actuators of the cooling path 4 and are preferably coupled to one or more models of the cooling path, which models can be filed in, for example, a model library 19. One of the models is preferably used for controlling the actuators. The cooling-path regulating means 12 forwards adjusting signals 101 to the cooling path 4 in the form of, for example, adjustment patterns for coolant valves.

Figure 2:
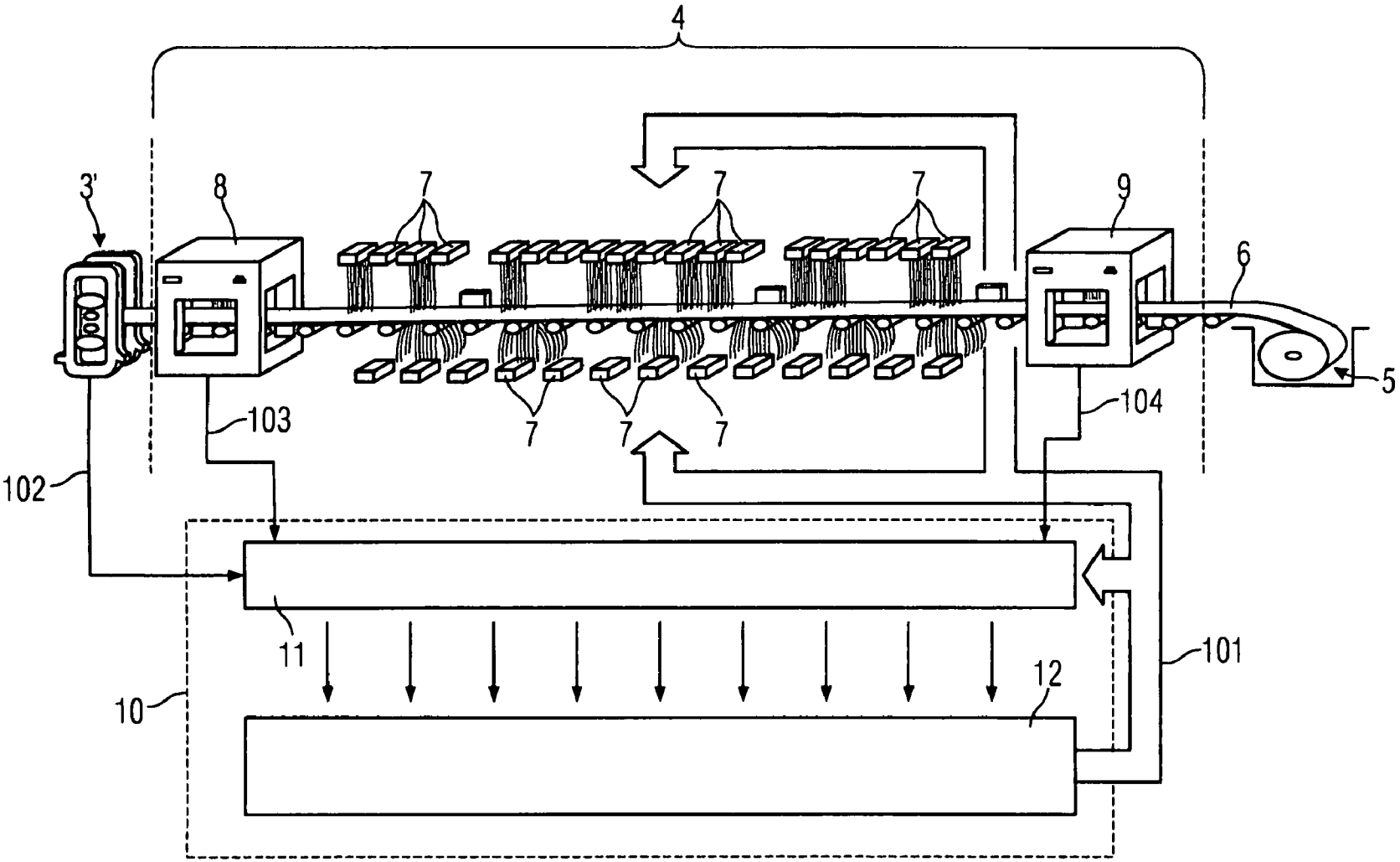
FIG. 2 shows a rolling mill's cooling path and a calculating device serving to control or, as the case may be, regulate it.

FIG. 2 describes the operating mode of the cooling-path monitor 11 and of the cooling-path regulating means 12 in more detail.

The cooling-path monitor 11 determines the status of the cooling path 4. Values such as, for example, the speed of the strip metal 6, strip temperatures and coolant temperatures, and coolant pressure serve as input parameters for the cooling-path monitor 11.

Further input variables are the settings of the actuators, meaning, therefore, preferably those of the valves 7.

A final-rolling-temperature measuring station 8 for measuring the temperature of the strip metal 6 is preferably located in the entry area of the cooling path 4. The temperature at the end of the finishing train 3 or, as the case may be, the temperature between the finishing train 3 and the cooling path 4 is measured there. A final-temperature measuring station 9 is preferably located at the end of the cooling path 4. The temperature ahead of the reeling device 5 or, as the case may be, at the end of the cooling path 4 is measured there. Input variables of the cooling-path monitor 11 are the input temperatures 103 of the strip metal determined at the final-rolling-temperature measuring station 8, the output temperatures 104 of the strip metal determined at the reel-temperature measuring station 9, and further strip data 102 determined preferably in the finishing train 3, for example at or shortly after its final roll stand 3'.

Valve settings 101 are conveyed from the cooling-path regulating means 12 to the cooling-path monitor 11, which settings are, however, as a rule not subjected to a plausibility check by said cooling-path monitor 11. The cooling-path monitor 11 always determines the current status of the cooling path 4.

Controlling or, as the case may be, regulating according to the invention takes place in a clocked fashion preferably in regulating steps. The cooling-path regulating means 12 determines the valve settings 101 of the valves 7 of the cooling path 4 for the respectively next regulating step preferably with an optimization problem being solved that will be described in more detail below.

According to the invention an iteration step is preferably carried out during each clocked pulse with at least one adjusting signal being applied to the system proceeding from the optimization problem's solution assigned to a current clocked pulse. Further updated measurands are preferably taken into account for a succeeding clocked pulse when the optimization problem is being solved. A closed control loop can be formed in this way.

It is advantageous if, given a large number of actuators as is typical for the cooling path 4, not individual valves but groups of valves are construed as the actuator when the preferably quadratic optimization problem is constructed. The calculated adjustment value is distributed among the individual valves via suitable switching heuristics. Combining valves into valve groups is especially advantageous particularly for optimization problem solving that takes place online, which is to say in realtime.

Figure 6:
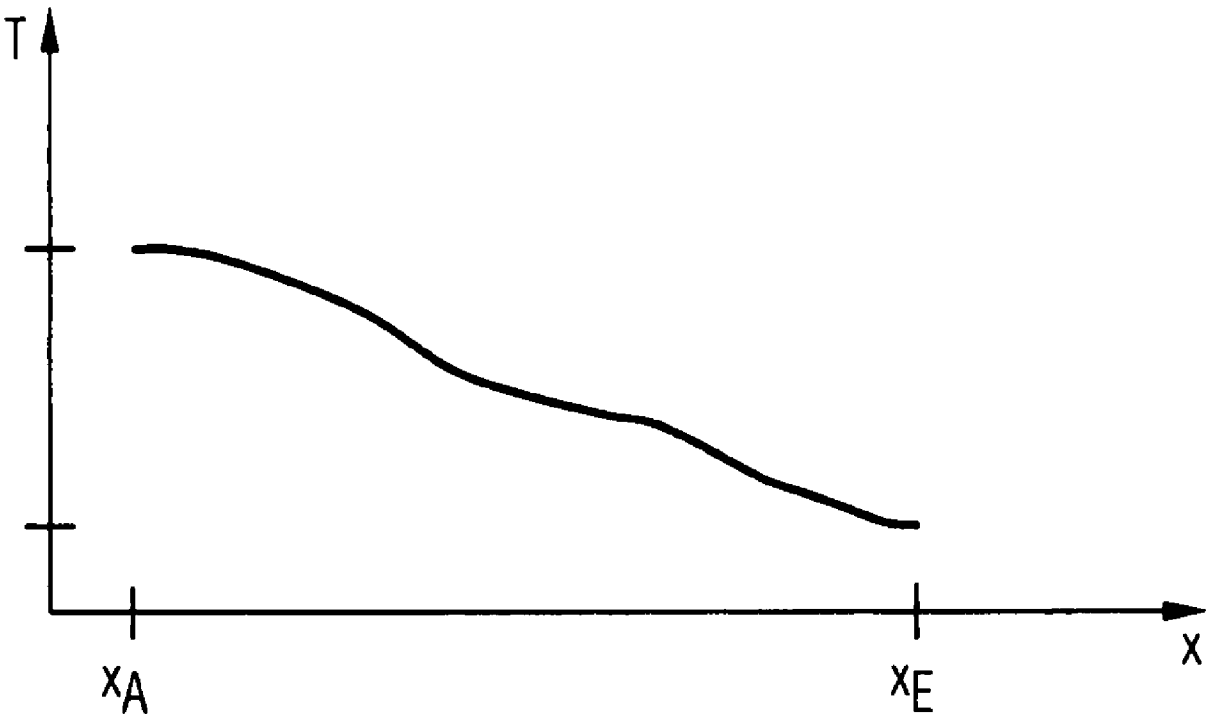
FIG. 6 shows a possible temperature gradient of strip metal in the cooling path.

FIG. 6 shows a possible temperature gradient T over the locations x along the cooling path 4, with said cooling path 4 being delimited by its start XA and by its end XE. A comparable scenario would result from applying a temperature gradient T over the time.

Figure 3:
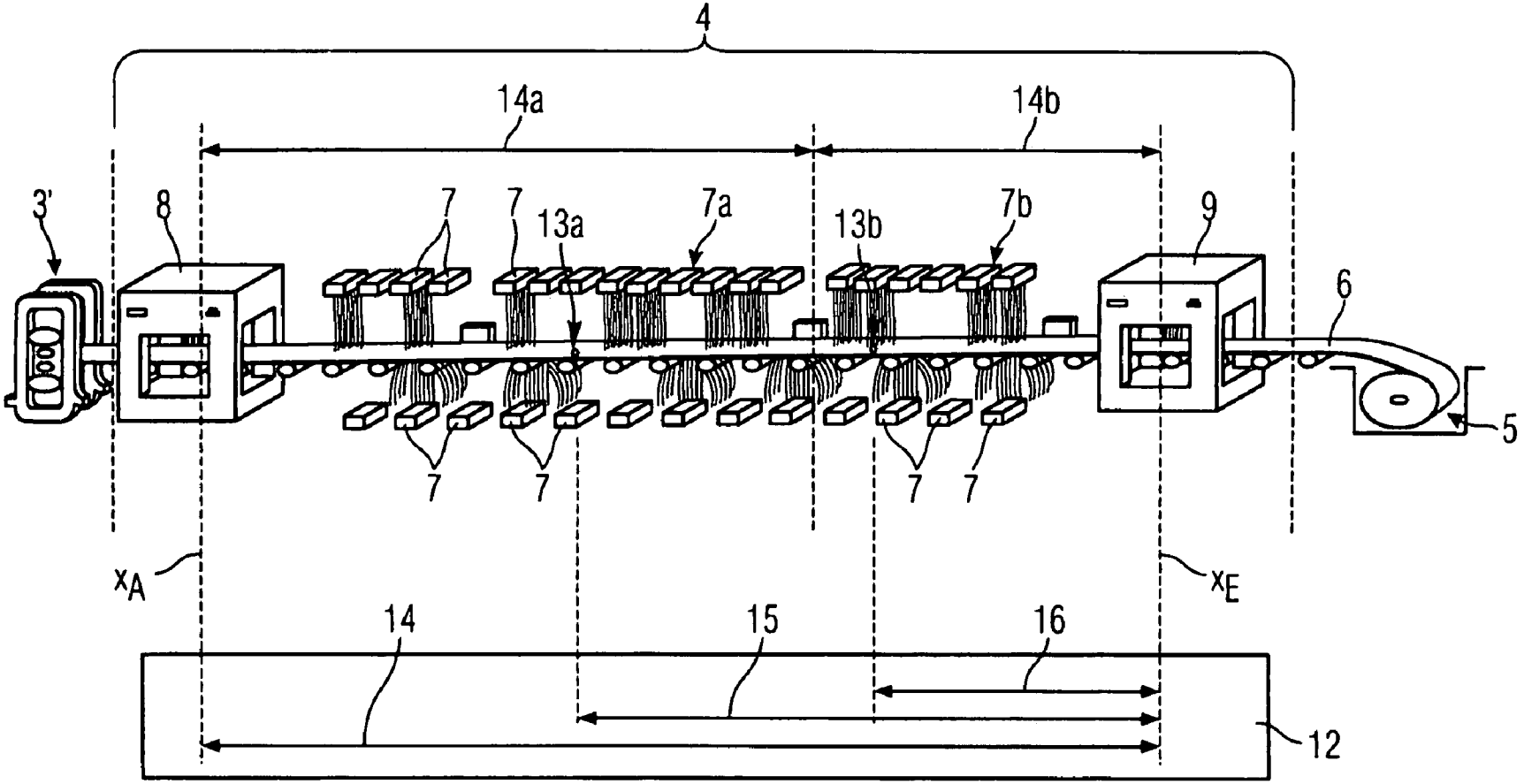
FIG. 3 shows a cooling path and a cooling-path regulating means schematically assigned thereto.

FIG. 3 shows model-predictive regulating of the cooling path in more detail. Preferably not individual valves 7*a* or, as the case may be, 7*b*, referred to in combination as 7, are herein driven by the cooling-path regulating means 12 but, instead, valve groups consisting of one or more valves 7. It is accordingly possible herein for, for example, the regulating section 14 to be subdivided into a plurality of partial sections 14*a* and 14*b*, with one valve group preferably being assigned to each partial section 14*a* or, as the case may be, 14*b*.

Within the limits of the regulating section 14, whose limits as a rule coincide with the cooling path's, a distinction can be made in terms of regulating between a main regulating section 15 and a compensating regulating section 16. Individual points on the strip (13*a*, 13*b*) are preferably route-tracked.

A model-predictive algorithm is employed for controlling and regulating the cooling path. Actuators for Nu time steps are herein projected into the future as the solution to a preferably quadratic optimization problem, with predictions being made with the model for Ny time steps.

Nu can be 1 or a natural number greater than 1. Only the calculated actuator settings for the first time step are as a rule implemented in the latter case. New calculations are made for the next time step taking current measurands or, as the case may be, predictive values into account.

Ny must be selected to be sufficiently large to overcome the longest dead time present. The longest dead time correlates to the longest distance between a temperature-measuring point and the position of the nearest free control valve connected upstream. A suitable, preferably linearized strip-temperature model is used for constructing the preferably quadratic optimization problem. Secondary equation and inequation conditions can easily be integrated into the preferably quadratic optimization problem. Actuator limitations and different cooling-path layouts can in this way be taken into account particularly advantageously and preferably in such a way that no major changes will have to be made to the calculating device 10 or, as the case may be, to the predictive-calculation module 21 and/or to the calculation module 22.

Model-predictive regulating of the cooling path can alternatively or additionally also be based on the enthalpy gradient in said cooling path. The enthalpy gradient over the location x or, as the case may be, over the time is herein comparable to the temperature gradient over the location (see also FIG. 6) or, as the case may be, over the time.

Figure 4:
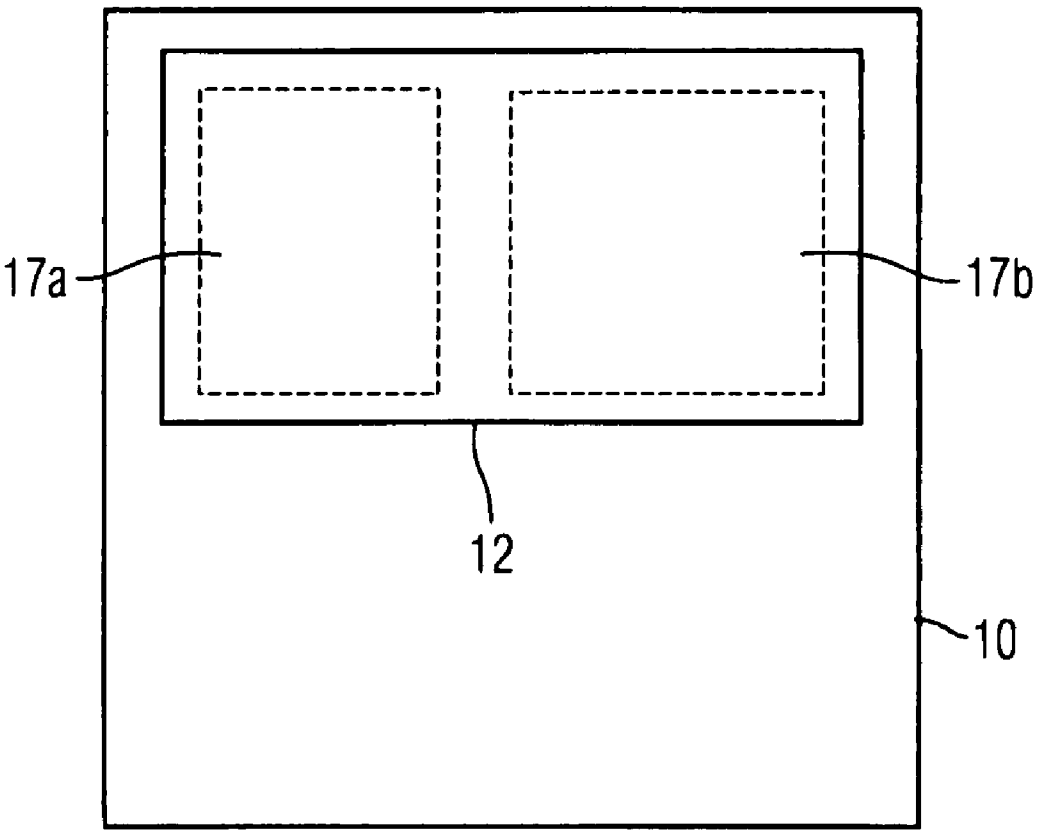
FIG. 4 shows possible modules of a cooling-path regulating means.

As shown in FIG. 4, it is possible for the calculating device 10 to have a module for cooling-path regulating 12 in turn having a plurality of partial regulating modules 17*a*, 17*b* corresponding to different regulating sections 14*a* and 14*b*.

Controlling or, as the case may be, regulating according to the invention of the cooling path 4 is independent of the cooling-path layout and, owing to model-predictive regulating, offers optimal control characteristics also at the limitations of adjustment. Specifications can be flexibly differently weighted for prioritizing purposes. Edge-masking can be integrated into the controlling or, as the case may be, regulating method according to the invention.

The method according to the invention can be embodied in such a way that the speed of the strip metal 6 can also be controlled, a factor that will also allow said method to be used for, for example, plate-rolling trains.

In particular a finishing train 3 can also be regulated according to the invention. Alongside strip speed, intermediate stand cooling devices are further possible actuators for a finishing train 3. Approximately 200 valves 7, for example, are a typical number of actuators for a cooling path. This is a significantly larger number of actuators than for a typical finishing train 3.

Cross-system controlling or, as the case may be, regulating for a plurality of system parts 1 to 5 can be achieved preferably as described below for, for example, a finishing train 3 and a cooling path 4.

For cross-system controlling or, as the case may be, regulating, preferably the temperature model of the finishing train 3 and the temperature model of the cooling path 4 are chained. By adding the target functions for both system parts 3 and 4 a preferably quadratic optimization problem with preferably linear secondary conditions is determined with the aid of which problem a common controlling method for both system parts 3 and 4 is provided. Optimizing of the problem will thus supply the settings for the intermediate stand cooling devices of the finishing train 3, the cooling-path valves 7 of the cooling path 4, and the speed of the strip metal 6, especially for the respective next regulating step.

The invention claimed is:

1. A method for controlling a temperature of strip metal within a technical installation of the steel industry, the strip metal transported through the technical installation, the method comprising:

providing a target temperature gradient of the strip metal;

route-tracking a plurality of points on the strip metal during the transport of the strip metal through the technical installation;

determining a number of temperature gradients for at least some of the points during the transport of the strip metal through the technical installation;

determining a target function for a plurality of actuators assigned to a control system of the technical installation, the control system adapted to control the technical installation, based on the determined temperature gradients, the target temperature gradient, and side conditions including factors influencing a temperature control included in the control system; and adjusting the actuators using the target function so that the temperature of the strip metal and the plurality of functions are controlled by the control system, wherein adjusting the actuators includes minimizing or maximizing the target function using a solving algorithm of an optimization problem.

2. The method according to claim 1, wherein the technical installation comprises a rolling train for rolling the strip metal after heating, and a cooling path along which the temperature of the strip metal is controlled, the cooling path arranged downstream of the rolling train relative to a transportation direction of the strip metal.

3. The method according to claim 1, wherein the optimization problem is a quadratic optimization problem.

4. The method according to claim 1, wherein at least one of the temperature gradients and/or the target temperature gradient are determined using a mathematical model.

5. The method according to claim 4, wherein the mathematical model is adapted online.

6. The method according to claim 1, wherein an actual enthalpy gradient and/or a desired enthalpy gradient is determined using a further mathematical model.

7. The method according to claim 6, wherein the further mathematical model is adapted online.

8. The method according to claim 1, wherein the solving algorithm includes predictive calculating.

9. The method according to claim 1, wherein the solving algorithm iteratively minimizes or maximizes the target function.

10. A method according to claim 9, wherein the solving algorithm includes a plurality of iteration steps executed at a clock pulse, each iteration step including determining a step-related solution to the optimization problem, and at least one adjusting signal is generated from the step-related solution and transmitted to at least one of the actuators in each iteration step.

11. The method according to claim 10, wherein determining the step-related solution in a succeeding clock pulse includes further measured values obtained from the technical installation.

12. The method according to claim 11, wherein the temperature of the strip metal is controlled in a closed control loop.

13. The method according to claim 1, wherein the side conditions include linear side conditions.

14. The method according to claim 1, wherein the temperature of the strip metal is controlled in a plurality of sections of the technical installation including a production line or a cooling path arranged downstream of a production line relative to a transportation direction of the strip metal.

* * * * *